US006438929B2

(12) United States Patent
Kume et al.

(10) Patent No.: US 6,438,929 B2
(45) Date of Patent: Aug. 27, 2002

(54) PACKAGING MACHINE

(75) Inventors: Satoshi Kume; Takashi Arao; Michio Ueda, all of Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/853,629

(22) Filed: May 14, 2001

(30) Foreign Application Priority Data

May 16, 2000 (JP) ..... 2000-143232

(51) Int. Cl.[7] ..... B65B 3/26
(52) U.S. Cl. ..... 53/493; 53/552
(58) Field of Search ..... 53/167, 493, 551, 53/552

(56) References Cited

U.S. PATENT DOCUMENTS 4,227,627 A 10/1980 Bennett ..... 222/282
4,566,249 A 1/1986 Schwerdtel ..... 53/55
5,029,430 A * 7/1991 Davis ..... 53/141
5,044,140 A * 9/1991 Iwano et al. ..... 53/167
5,782,344 A 7/1998 Edwards ..... 206/217
5,822,949 A 10/1998 Naoi ..... 53/55
5,832,700 A * 11/1998 Kammler et al. ..... 53/502

FOREIGN PATENT DOCUMENTS

FR 2098874 3/1972
FR 2250676 6/1975

* cited by examiner

*Primary Examiner*—Scott A. Smith
*Assistant Examiner*—Chukwurah Nathaniel
(74) *Attorney, Agent, or Firm*—Armstrong, Westerman & Hattori, LLP

(57) ABSTRACT

A packaging machine comprises a filling device (13) for filling a tube T of packaging material having an open upper end and a closed lower end with contents in a predetermined amount at a time, and a device (14) for forming containers C by sealing and cutting the filled tube T transversely thereof into a length corresponding to one container at a time. The amount of contents to be filled into the container and the capacity of the container are so determined that the capacity is greater than the amount of contents to be filled.

7 Claims, 2 Drawing Sheets

PACKAGING MACHINE

BACKGROUND OF THE INVENTION

The present invention relates to packaging machines for producing containers, for example, from a web of packaging material, with liquid food or like contents, accommodated in the containers.

Packaging machines are already known which are adapted to form a web of packaging material into a tube having a closed lower end, fill liquid contents into the tube with the liquid level held at a specified level, transport the filled tube a distance at a time which distance corresponds to the length of one container, seal and cut the tube transversely thereof to form a pillowlike container, and eventually form the container into a rectangular parallelepipedal completed container, the tube being sealed and cut under the liquid level.

The conventional packaging machine wherein the tube is sealed and cut under the liquid level is likely to produce faulty seals if the contents contain a fibrous material, or the like, since such a material will be present at the portion to be sealed as an extraneous matter. Further, when the contents have a relatively high temperature of about 65 to about 85° C., the portion sealed under the liquid level will not be fully cooled to become faulty. In the case where the contents filling the container contain ingredients which are likely to settle, it is desirable to shake the container to eliminate the deposit when so required. However, if the tube is sealed under the liquid level, the container is filled up with the contents and encounters difficulty in eliminating the deposit by shaking.

SUMMARY OF THE INVENTION

An object of the present invention is to overcome the above problems and to provide a packaging machine which is adapted to produce containers without permitting extraneous matter to be present in the portion to be sealed while permitting the sealed portion to be fully cooled to eliminate faulty seals, the containers being further shakable to eliminate settling of ingredients.

The present invention provides a packaging machine comprising a filling device for filling a tube of packaging material having an open upper end and a closed lower end with contents in a predetermined amount at a time, and a device for forming containers by sealing and cutting the filled tube transversely thereof into a length corresponding to one container at a time, the amount of contents to be filled into the container and the capacity of the container being so determined that the capacity is greater than the amount of contents to be filled.

With the packaging machine of the present invention, the amount of contents to be filled into the container and the capacity of the container are so determined that the capacity is greater than the amount of contents to be filled, so that the container is sealed at a position above the level of the contents within the container. This eliminates the likelihood that the contents will be in contact with the portion to be sealed, rendering the sealed portion free from extraneous matter, while the sealed portion can be efficiently cooled without being influenced by the temperature of the contents. These features eliminate faulty seals. Since the container is sealed with air remaining therein, the sealed container has an air layer therein. Because of the presence of the air layer, the container can be shaken to obviate the settling of ingredients.

The tube can be reliably filled with the contents in a specified amount at a time when the filling device comprises a filling pipe having the tube fitted therearound, a metering cylinder connected to the filling pipe, and an upstream check valve and a downstream check valve disposed upstream and downstream from the metering cylinder respectively.

When the filling pipe is provided at a lower end thereof with a discharge opening positioned in the vicinity of the lower end of the tube, and if the discharge opening is adapted to be opened and closed by the downstream check valve, the discharge opening can be reliably opened and closed by the downstream check valve to meter the contents more accurately, and can also be prevented from dripping.

When the tube has the open upper end positioned within a chamber, and if the chamber is held at a positive internal pressure, the container can be sealed while being held at a positive internal pressure. If the internal pressure of the container is insufficient, the container, which is circular in cross section when to be shaped to a rectangular or square form in cross section (see FIG. 2) before sealing, will not always be so shaped properly, whereas since the interior of the container is held at a positive pressure when to be sealed, the container can be accurately shaped to the desired form.

Preferably, the chamber has a blower connected thereto and is provided with a pressure relief valve.

The filling device may comprise a metering cylinder having therein a piston, which is connected by a rod to an eccentric wheel mounted on an output shaft of a motor. The amount of contents to be filled into the container is then variable by altering the radius of gyration of the eccentric wheel.

The forming device has sealing jaws openable and closable and movable upward and downward with the tube positioned therebetween, and the capacity of the container is variable by altering the stroke of the sealing jaws.

DESCRIPTION OF THE PREFERRED EMBODIMENT

An embodiment of the invention will be described below with reference to the drawings.

Figure 1:
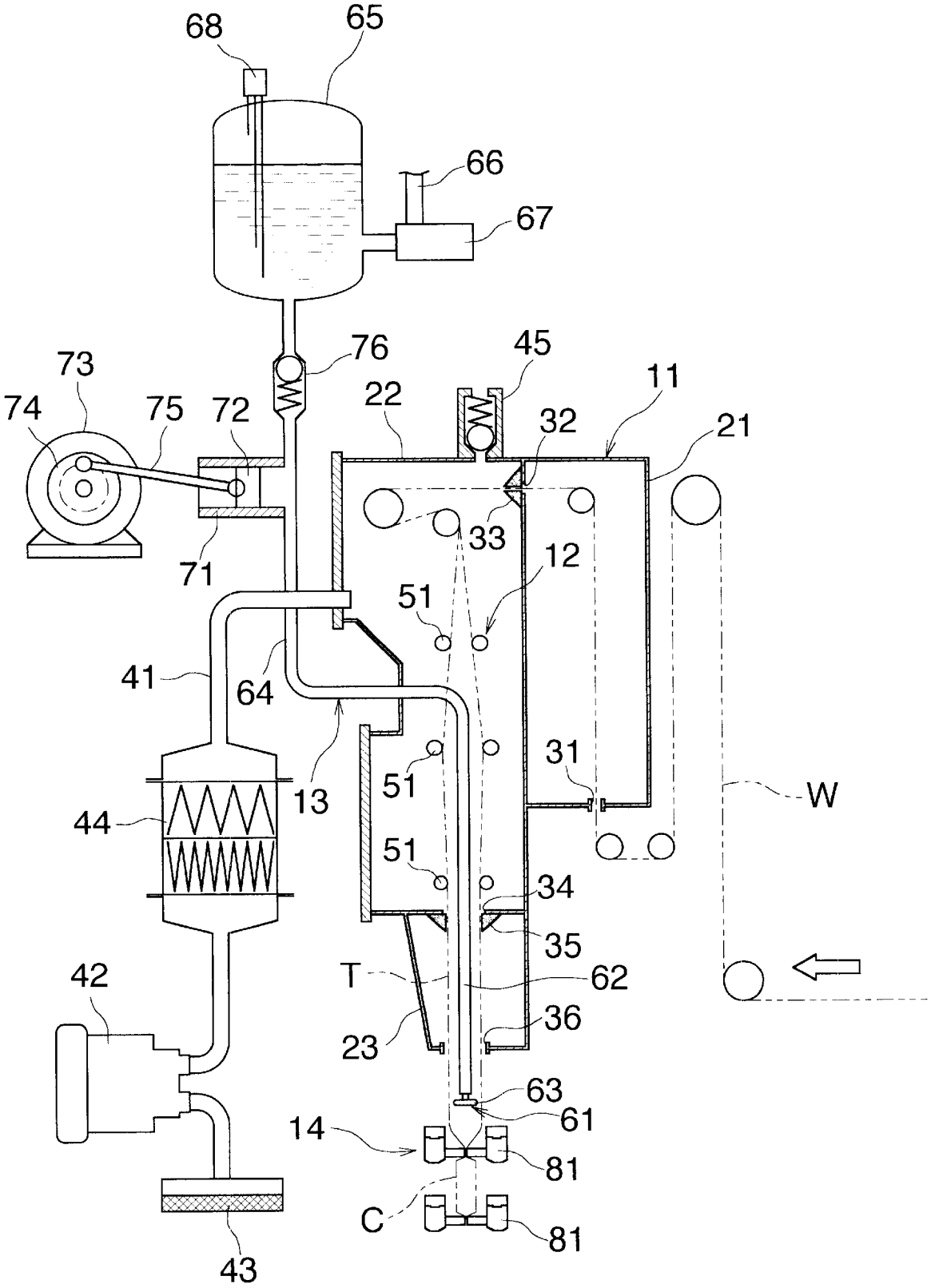
FIG. 1 is a diagram schematically showing the construction of a packaging machine embodying the invention.

FIG. 1 shows a packaging machine, which comprises an aseptic chamber 11 for guiding thereinto a web W of packaging material which is made of a paper-base laminate having a thermoplastic resin layer over each of its opposite surfaces, a tube forming device 12 for forming the web W into a tube T within the aseptic chamber 11, a filling device 13 for filling the tube T with contents, and an uncompleted container forming device 14 for sealing and cutting the filled tube T transversely thereof while transporting the tube T a distance at a time, which distance corresponds to the length of one container to form a pillow like incomplete container C.

The container C formed by the device 14 is eventually made into a rectangular parallelepipedal completed container by an unillustrated completed container forming device.

The aseptic chamber 11 comprises a side compartment 21, main compartment 22 and lower compartment 23.

The side compartment 21 has a bottom wall provided with a web inlet 31. The side compartment 21 is separated from the main compartment 22 by a partition wall having a web hole 32 formed therein. The hole is provided with seal means 33. The lower compartment 23 is separated from the main compartment 22 by a partition wall having a tube hole 34 formed therein. This hole 34 is also provided with seal means 35. The lower compartment 23 has a bottom wall provided with a tube outlet 36.

The web W is passed through the web inlet 31 and led through the web hole 32 into the main compartment 22, in which the web is formed into the tube T, which is guided through the tube hole 34 into the lower chamber 23 and led out of the aseptic chamber 11 through the tube outlet 36. The tube T has a lower end which is guided to the incomplete container forming device 14.

The main compartment 22 has connected thereto an outlet end of an aseptic air supply pipe 41. The pipe 41 has the other end connected to the outlet of a blower 42. A dust collecting filter 43 is connected to the inlet of the blower 42. The air supply pipe 41 is provided with a HEPA filter 44. The main compartment 22 has a top wall provided with a pressure relief valve 45.

The air forced out from the blower 42 is led through the HEPA filter 44 to the main compartment 22, whereby the interior of the main compartment 22 is held at a positive pressure of 0.05 to 0.1 kgf/cm$^2$.

The tube forming device 12 comprises a plurality of guide rollers 51 for progressively lapping opposite side edge portions of the web W over each other, and unillustrated means for sealing the resulting lap of the web W.

The filling device 13 has a vertical filling pipe 62 having the tube T fitted therearound and provided with a discharge opening 61 at its lower end. The filling pipe 62 extends downward from the midportion of height of the main compartment 22 through the lower compartment 23 and is projected outward to below the compartment 23. The discharge opening 61 is positioned in the vicinity of the lower end of the tube T. The opening 61 is provided with a downstream check valve 63.

Connected to the upper end of the filling pipe 62 is an end of horizontal portion of an L-shaped connecting pipe 64 extending from outside the main compartment 22. The connecting pipe 64 has an upper end connected to a filling liquid tank 65. A filling liquid supply pipe 66 is connected to the side wall of the tank 65 in the vicinity of its lower end, with an inlet valve 67 provided between the pipe 66 and the tank 65. The tank 65 has a top wall provided with a level gauge 68.

A metering cylinder 71 is connected to an intermediate portion of the connecting pipe 64. The metering cylinder 71 has a piston 72 accommodated therein. The piston 72 is connected by a rod 75 to an eccentric wheel 74 mounted on the output shaft of a motor 73. An upstream check valve 76 is disposed upstream from and immediately adjacent to the metering cylinder 71.

When the piston 72 is moved leftward in FIG. 1, the liquid to be filled is caused to flow into the metering cylinder via the upstream check valve 76. When the piston 72 is moved rightward, the liquid flows out of the cylinder 71 in an amount corresponding to the stroke of the piston 72, with the upstream check valve 76 held closed. A quantity of the liquid corresponding to the amount of outflow from the cylinder 71 pushes the downstream check valve 63 open to flow out of the discharge opening 61.

The stroke of the piston 72 is altered by varying the radius of gyration of the eccentric wheel 74, whereby the amount of liquid to be discharged from the metering cylinder 71 is varied.

The incomplete container forming device 14 has two pairs of sealing jaws 81 which are openably and closably arranged with the tube T positioned therebetween for heat-sealing the tube T transversely thereof. Each pair of sealing jaws 81 are moved upward and downward with a stroke corresponding to the length of one container, closed by the downward stroke and opened by the upward stroke. The stroke of each pair of sealing jaws 81 provides an amount of feed corresponding to the length of one container. One of each pair of sealing jaws 81 is provided with an unillustrated cutter, and the seal portion is cut at the midportion of its width by the cutter, whereby a portion of the tube T corresponding to one container is cut off. The content of the container is variable by altering the stroke of each sealing jaws 81.

Every time a specified amount of liquid is filled into the tube T from the discharge opening 61, the pairs of sealing jaws 81 are moved up and down to open and close.

The capacity of the container cut off and the amount of liquid to be discharged from the discharge opening 61 in one cycle and to be filled are so determined that the capacity is greater than the amount of liquid to be filled. This is a noteworthy feature. For example, if the amount of liquid to be filled is 180 cc, the capacity is 200 cc.

Figure 2:
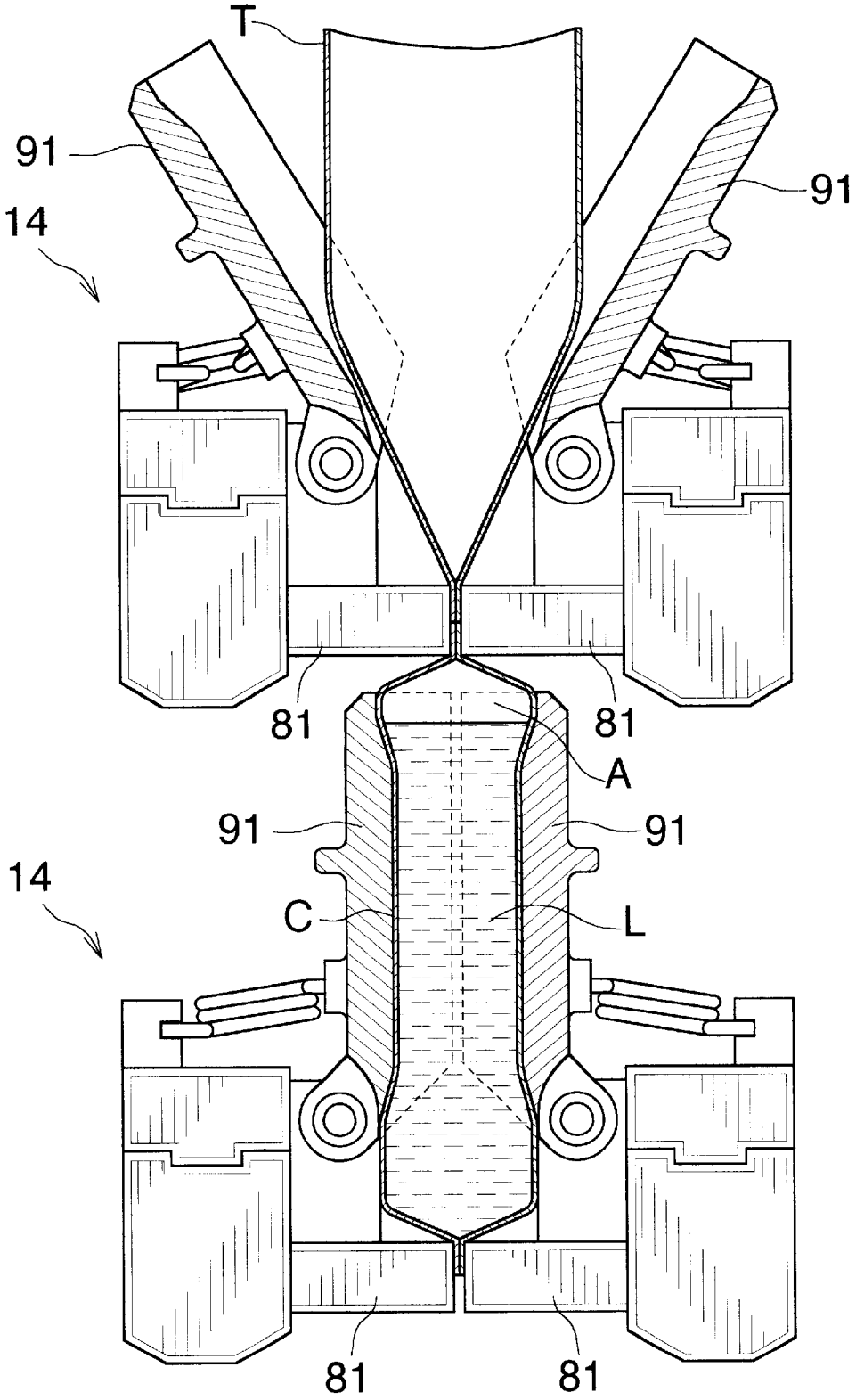
FIG. 2 is a diagram for illustrating the sealing operation to be performed by the packaging machine.

FIG. 2 shows one pair of sealing jaws 81 operated for sealing in the preceding cycle which are shown at a lower position, and the other pair of sealing jaws 81 operated for sealing in the current cycle are shown at the upper position. Each pair of sealing jaws 81 are provided with volume flaps 91. After sealing in the preceding cycle and before sealing in the current cycle, the volume flaps 91 hold the container C therebetween at opposite sides thereof, whereby the container C, which is circular in cross section. If the pressure of the container C is insufficient, the container C will not be brought into intimate contact with the volume flaps 91 and is likely to be shaped improperly, whereas the internal pressure of the chamber 11 acting on the container C obviates this likelihood.

Furthermore, the position where the upper sealing jaws 81 seal the tube T is above the level of the liquid L filling the tube T, such that the tube portion to be sealed is held out of contact with the liquid L.

The container C formed further has in its interior a head space A filled with air of positive pressure. This is a favorable condition for finishing the container C to an eventual form by the subsequent step.

When the container is shaken, the settling matter within the container is readily diffused through the liquid therein.

The aseptic chamber 11 need not always be aseptic but may be so constructed as to hold a clean atmosphere of positive pressure therein.

What is claimed is:

1. A packaging machine comprising a filling device for supplying a tube of packaging material having an open upper end and a closed lower end with contents in a predetermined amount at a time, and a device for forming containers including means for sealing said tube of packaging material and means for cutting the tube transversely thereof into a length corresponding to one container at a time, said filling device containing a filling pipe around which the tube is fitted for supplying an amount of contents into the container, a metering cylinder connected to the filling pipe, and an upstream check valve and a downstream check valve disposed upstream and downstream from the metering cylinder, respectively, for providing the container with a capacity determined to be greater than the amount of contents to be supplied to the tube.

2. A packaging machine according to claim 1 wherein the filling pipe is provided at a lower end thereof with a discharge opening positioned adjacent a lower end of the tube, and said downstream check valve providing means for opening and closing the discharge opening.

3. A packaging machine according to any one of claims 1 or 2 including a chamber within which an open upper end of the tube is positioned, and the chamber being held at a positive internal pressure.

4. A packaging machine according to claim 3 wherein the chamber has a blower connected thereto and is provided with a pressure relief valve.

5. A packaging machine according to claim 1 wherein the filling device comprises a metering cylinder having a piston therein, and the piston is connected by a rod to an eccentric wheel mounted on an output shaft of a motor, the amount of contents to be supplied into the container being variable by altering the radius of gyration of the eccentric wheel.

6. A packaging machine according to claim 1 wherein the means for sealing said upper end of said tube of packaging material has openable and closable sealing jaws, means for positioning the tube between the sealing jaws, and means for moving said sealing jaws upward and downward whereby the capacity of the container is variable by altering the stroke of the sealing jaws.

7. A packaging machine according to any one of claims 1, 2, 5 or 6 wherein the container is sealed and cut by the device for forming containers above the level of the liquid filling the tube.

* * * * *